United States Patent [19]

Motta et al.

[11] Patent Number: 4,462,325

[45] Date of Patent: Jul. 31, 1984

[54] STITCH ADJUSTMENT DEVICE FOR SEWING MACHINES

[75] Inventors: Bruno Motta, Milan; Erminio Nava, Arese, both of Italy

[73] Assignee: Rockwell-Rimoldi S.p.A., Italy

[21] Appl. No.: 474,111

[22] Filed: Mar. 10, 1983

[30] Foreign Application Priority Data

May 17, 1982 [IT] Italy ..... 21309 A/82

[51] Int. Cl.[3] ..... D05B 27/02

[52] U.S. Cl. ..... 112/315; 112/200

[58] Field of Search ..... 112/200, 315

[56] References Cited

U.S. PATENT DOCUMENTS

| | | | |
|---|---|---|---|
| 2,161,579 | 6/1939 | Kaier | 112/315 |
| 2,491,449 | 12/1949 | Hirsch | 112/315 |
| 2,718,860 | 9/1955 | Hale | 112/315 |
| 2,851,976 | 9/1958 | Covert | 112/315 |

*Primary Examiner*—Werner H. Schroeder
*Assistant Examiner*—Andrew M. Falik

[57] ABSTRACT

An apparatus for adjusting stitch length in a sewing machine by means of a selectively adjustable eccentric possessing a self-locking device. The apparatus includes a support collar fixed on the machine's main shaft with an eccentric support mounted on the support collar which is operatively connected to a connecting rod for actuating the machine's feed dog. The eccentric support includes a central opening within which the adjustable eccentric is operatively disposed and which forms an integral part of a support ring rotatably mounted on the machine's main shaft. A manually operable push button serves to hold the support ring stationary and to release the self-locking device. The machine includes the conventional hand wheel fixed on one end of the machine's main shaft and, while the pushbutton is held in a depressed condition, the self-locking device remains in a released state thus enabling the selective rotation of the machine's main shaft by the hand wheel. This rotation effects a change in position of the adjustable eccentric within the eccentric support and the amount the connecting rod travels to actuate the feed dog. The selective positioning of the adjustable eccentric is maintained by release of the push button that activates the self-locking device.

3 Claims, 5 Drawing Figures

STITCH ADJUSTMENT DEVICE FOR SEWING MACHINES

BACKGROUND OF THE INVENTION

1. Field of the Invention

The present invention pertains to a device having a selectively adjustable eccentric with a self-locking feature operatively connected to a connecting rod that initiates activation of a sewing machine's feed dog, thereby, controlling the rate of advance of a workpiece through the sewing zone and the length of stitch formed in the workpiece.

2. Description of the Prior Art

Stitch adjusting devices are well known to those conversant in the art which utilize an adjustable eccentric carried by a support collar that is fixed on a sewing machine's main shaft. Such devices include a control eccentric in operative association with the adjustable eccentric which has a connecting rod for advancing the feed dog that can be selectively positioned eccentrically on the support collar with respect to the main shaft. The control eccentric has an elongated inner passage which houses the adjustable eccentric that forms an integral part of a support ring which is rotatably mounted on the machine's main shaft. This support ring is adapted to be held stationary by means of a push button operable externally of the machine or which is connected to a member that is fixed to the machine's main shaft whereby the means connecting the ring to the member define toothed elements. These toothed elements have unidirectional teeth or, in other words, sawtooth shaped teeth which are connected to the support ring and are urged by spring means against teeth of conforming configuration on the member fixed to the machine's main shaft.

A device of the above type is shown and described in U.S. Pat. No. 2,161,579 which satisfactorily performs its intended function but presents a problem when the feed dog is subjected to heavy material or during the crossing of seams by becoming blocked with the result that a condition develops whereby the toothed element slides on the teeth of conforming configuration on the member fixed to the machine's main shaft which overrides the pressure of the spring. A condition of this nature inevitably leads to the lengthening of the stitch since the eccentric, not being firmly positioned, has a tendency to become displaced externally with respect to the shaft.

Another device of the above type is shown and described in U.S. Pat. No. 2,491,449 which includes a member with forwardly disposed teeth fixed on the main shaft of the machine. Within this member an element is engaged which is pivoted on a ring that is free to rotate with respect to the main shaft. This device also performs its intended function satisfactorily but presents a problem when attempting to obtain a fine setting of the adjustable eccentric. Such a condition can be attributed to the nature of the teeth which cannot be provided with a fine pitch.

An object of the invention is to provide a stitch adjustment device which, upon obtaining a selected eccentricity that corresponds to a desired stitch length, will be maintained unaltered under all possible sewing conditions including the stitching of heavy material and the crossing of seams.

Another object is to provide a stitch adjustment device which will provide every possible adjustment for a desired stitch length and with the ability of obtaining infinitesimally small values thereof.

SUMMARY OF THE INVENTION

The stitch adjustment device according to the invention utilizes an adjustable eccentric of the type described supra as well as a support collar fixed on the machine's main shaft. A control eccentric is adjustably mounted on the support collar and includes a connecting rod for initiating actuation of the feed dog. The control eccentric forms part of an eccentric support that serves to selectively position the control eccentric along the support collar eccentrically with respect to the machine's main shaft. The control eccentric is provided with an elongated internal passage within which the adjustable eccentric is disposed and is connected to a support ring that is rotatably mounted on the main shaft. A manually operable push button is provided for holding the support ring stationary while rotating the main shaft by means of the machine's hand wheel to selectively locate the adjustable eccentric and through the control eccentric and the connecting rod associated therewith cause the feed dog to travel the distance selected. The means for holding the support ring stationary includes a circular member fixed to the main shaft and disposed in operative association with a sector element that is fixedly mounted on the support ring. This sector element is provided with two inclined planar surfaces that define wedged seatings for two friction rollers disposed between the inclined planar surfaces and an internal cylindrical surface provided on the circular member.

Intermediate this internal cylindrical surface and the sector element a flange plate is provided which has two spaced arms that are adapted to engage and displace the friction rollers a sufficient distance to release them from their wedged seatings that define the invention's self-locking device. Another characteristic of the invention is that a coil spring is interposed between the flange plate and the sector element and serves to continually urge the flange plate toward the internal cylindrical surface of the circular member. Also, the push button includes an end disposed in operative association with a radial groove in the support ring and is adapted to engage the flange plate in a manner to overcome the forces of the coil spring and release the rollers from their wedge seatings to hold the support ring stationary and to release the circular member with respect to the support ring. The sector element is provided with two inclined planar surfaces which together with the internal cylindrical surface of the circular member define the wedged seatings for the two rollers that are wedged therebetween. These rollers are engaged by two biasing members interposed between them and the sector element which continually urge them to their seating position. When the push button is actuated, a pair of spaced arms on the flange plate push against the rollers to overcome the forces of the biasing members so as to release the self-locking device. The flange plate is provided with an integrally formed key element that serves to guide it in the support ring's radial groove upon actuation of the push button and, when the latter is not actuated, the arms of the flange plate are disposed in spaced relation to the rollers.

These and other characteristics of the invention will become more fully apparent by reference to the appended claims and as the following detailed description proceeds in reference to the figures of drawing wherein:

DESCRIPTION OF THE PREFERRED EMBODIMENT

Figure 1:
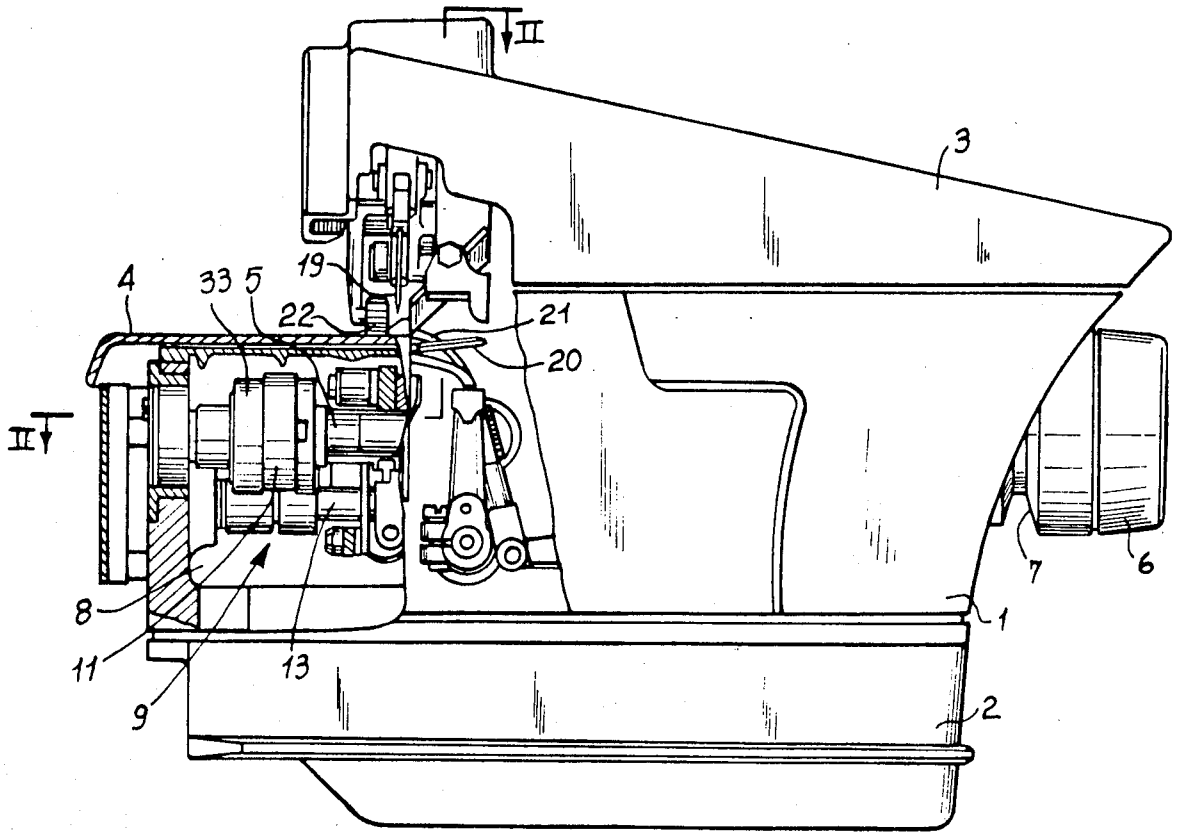
FIG. 1 is a view in front elevation and partially in section of a sewing machine to which the invention is applicable.
Figure 2:
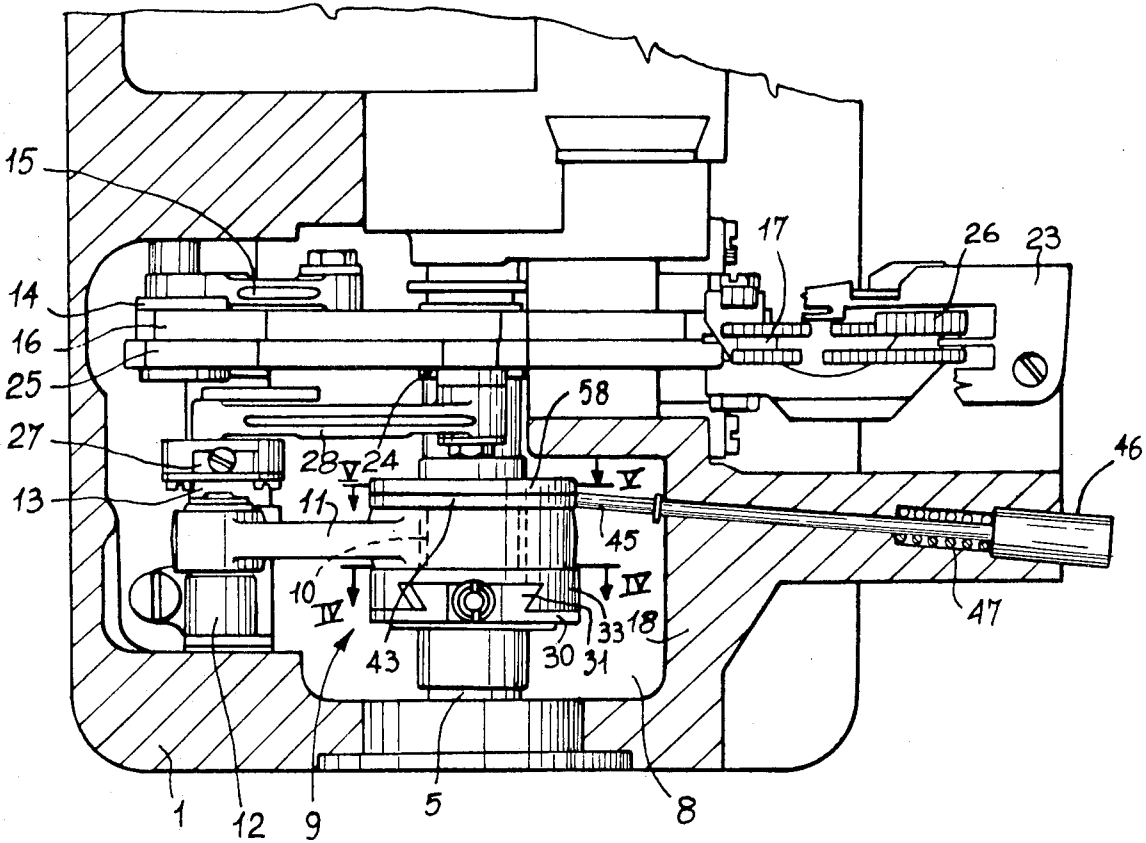
FIG. 2 is a sectional view of the sewing machine as seen looking in the direction of the indicating arrows of line II—II in FIG. 1.

By way of example, the present invention has been shown as applied to an industrial sewing machine of the Whipstitch Type. Referring now to FIG. 1, the machine includes, among its many parts, a base 1, a lower container 2 for the machine's lubricant and an upright member 3 disposed above the base. These elements define the machine's framework which also includes a horizontal planar surface 4 that serves to support a workpiece as it is advanced through the stitching zone. Contained within the framework the various mechanisms are suitably supported for causing the machine to perform its intended function. In particular, within the base 1 the machine's main shaft (FIGS. 1 and 2) is depicted by numeral 5 and is rotatably mounted with one end thereof terminating externally of the machine whereat it has a hand wheel 6 fixed thereon that is provided with a grooved pulley 7 which is adapted to be connected to any suitable source of drive (not shown).

The opposite end of the main shaft 5 terminates within chamber 8 whereat it supports a workpiece transporting device 9 which includes a control eccentric 10 having one end of a connecting rod 11 mounted thereon and with its opposite end journaled on an arm 12 carried by an oscillatably driven shaft 13. This oscillatably driven shaft 13 is also provided with another arm 14 similar to arm 12 which is connected by means of a connecting rod 15 to one end of a slide member 16. The opposite end of this slide member 16 has a feed dog 17 mounted thereon. This feed dog is mounted in a conventional manner externally of the machine's frame whereat it is separated from the chamber 8 by a dividing wall 18. In FIG. 1, the machine's needle is identified by numeral 19 and cooperates in the usual manner with the lower stitching instrumentalities that are defined by the loopers 20 and 21. A conventional presser foot 22 is disposed in operative association with the horizontal planar surface 4 and cooperates with the feed dog 17 to effect advance of a workpiece during the formation of a seam.

The horizontal planar surface 4 supports a well known type of needle plate 23 in a conventional manner whereby it is disposed in operative association with the feed dog 17 and presser foot 22. The workpiece transporting device 9 acts on the slide member 16 in a manner whereby the feed dog 17 mounted thereon is caused to travel in a pathway generated by the combination of horizontal and vertical movements by an eccentric 24 mounted on the main shaft. The two movements are orthogonal to each other and, being combined, they are effective in first moving the feed dog 17 in an upwardly direction so that it projects through the needle plate 23 and thence rearwardly in order to transport the workpiece being sewn, thence downwardly to a position below the needle plate and finally in a forwardly direction to its initial position for repeating the cycle. It should be understood that the invention could be applied to sewing machines which are provided with a differential type transport device. Such machines are provided with a second slide member 25 having a second feed dog 26 that is mounted in alignment with the feed dog 17. The second slide member 25 receives its drive from the osicllatably driven shaft 13 by means of an arm 27 and a connecting rod 28. The structure of the differential transport device and its operation will not be described in greater detail in this description because they are well known and are not considered essential for the purpose of the invention.

The invention includes a support collar 30 that is fixed on the main shaft 5 by means of a set screw 29 (FIG. 3) and is provided with a dovetail shaped guide 31 on which a support member 33 having a groove 32 of conforming configuration is mounted for selective positioning along the length of the dovetail shaped guide 31. This support member 33 is fixed to the control eccentric 10 on which one end of the connecting rod 11 is operatively connected.

Figure 3:
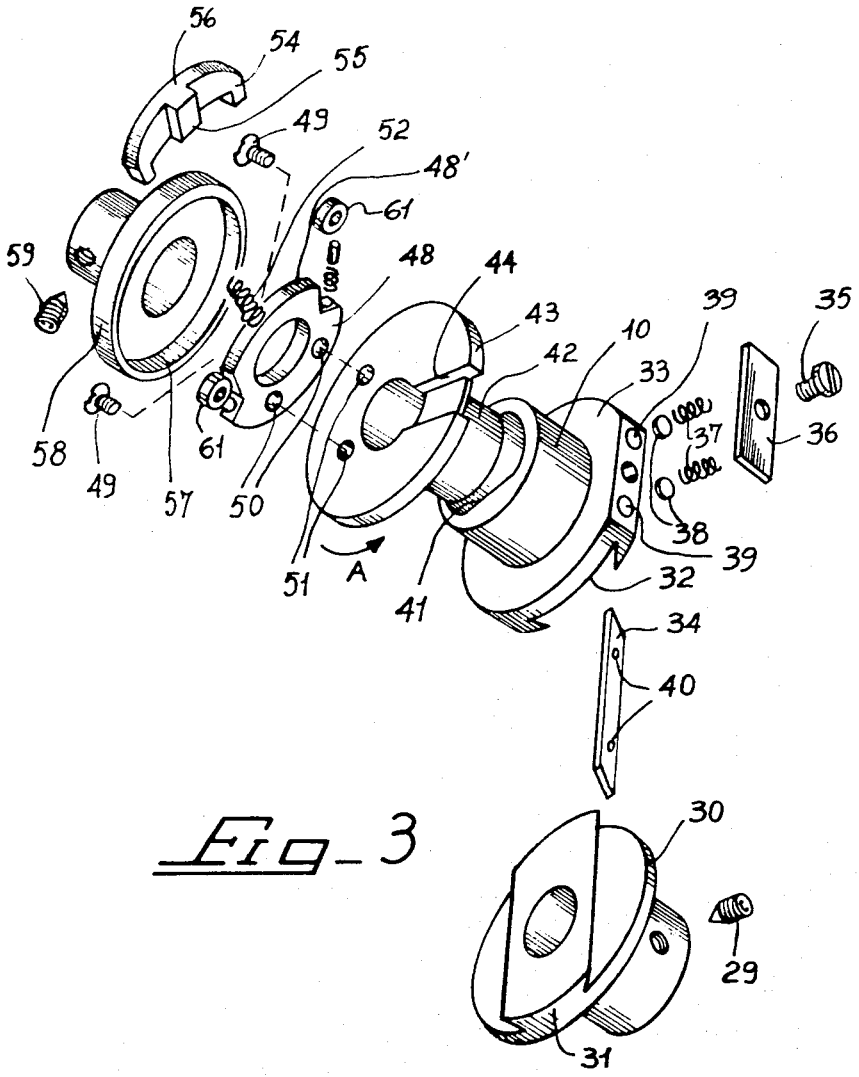
FIG. 3 is a perspective view in exploded form showing the elements of the device comprising the invention.
Figure 4:
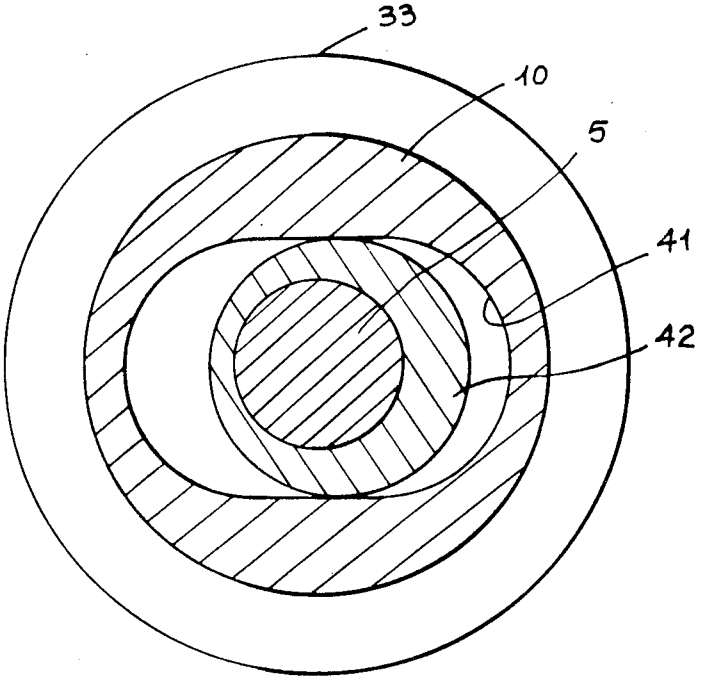
FIGS. 4 and 5 are sectional views as seen looking in the direction of the indicating arrows IV—IV and V—V, respectively, in FIG. 2.

As shown in FIG. 3, a shim plate 34 is provided which assembles between one side of the dovetail shaped guide 31 and the side of the groove 32 and serves as a means for compensating for wear between these elements. When wear between these elements develops, the shim plate 34 is adjustable to take up the wear clearance by means of a screw 35 for attaching a plate 36 in opposition to the pair of springs 37 to the exterior surface of the support member 33. The surface on which this plate 36 assembles (FIG. 3) includes a pair of spaced holes 39 within which balls 38 are disposed. One side of these balls 38 are in engagement with the springs 37 and the opposite sides are adapted to engage the indentations 40 provided on the shim plate 34. It is easily understood that the turning of screw 35 in one direction or the other will cause the springs 37 to exert more or less pressure on the balls 38 as is required.

The control eccentric 10 is provided with an internal passage 41 that is elongated in a direction transversely to the axis of the groove 32 as well as to the direction of movement of the latter.

Within the passage 41 a second or adjustable eccentric 42 is assembled which is fixed to and extends from one side of a support ring 43 which is rotatably mounted on the main shaft 5. This support ring 43 is provided with a radial groove 44 which is adapted to receive an end 45 (FIG. 2) of a manually operable push button 46 which, when activated, is in opposition to the forces of a return spring 47. On the planar end surface of the support ring 43 a sector 48 is assembled by means of cap screws 49 passing through holes 50 in the sector and thence into threaded holes 51 provided in the planar and surface.

Figure 5:
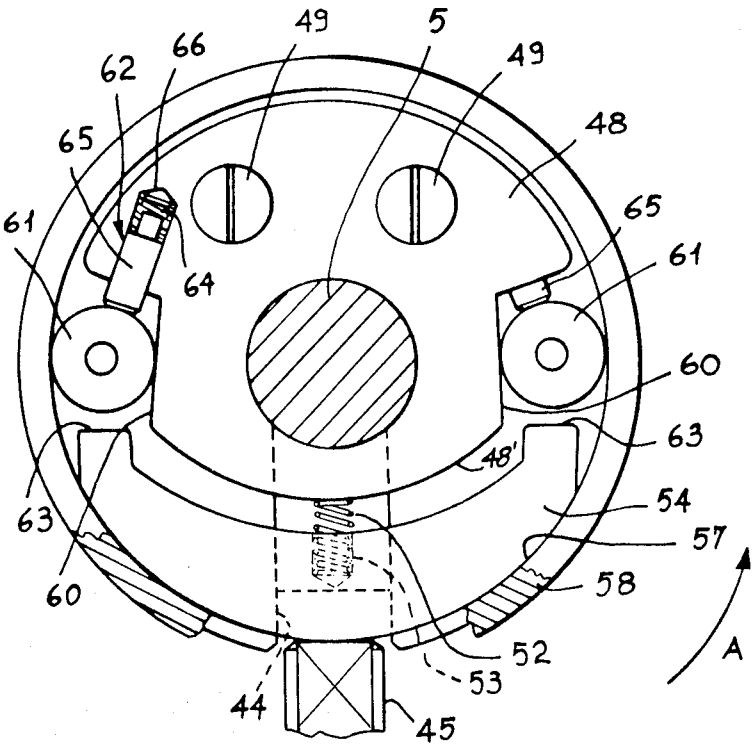

As shown in FIG. 5, one end of a coil spring 52 engages a curved surface 48' of the sector 48 and its opposite end is seated within a cavity 53 formed in a flange plate 54. This flange plate 54 is provided with an integrally formed key element 55 which assembles in the radial groove 44 so as to guide the flange plate 54 during the movement of its surface 56 toward and away from the internal cylindrical surface 57 of the circular member 58. This circular member 58 is fixedly mounted on the main shaft 5 by means of a set screw 59 and is disposed in operative association with the support ring 43.

When it is necessary to maintain the support ring stationary for the purpose of adjustment of the stitch length, the push button 46 is actuated in opposition to the return spring 47 until the end 45 enters the radial groove 44 and engages the surface 56 of the flange plate 54. This engagement of the end 45 with the surface 56 causes the flange plate 54 to move toward the sector 48 and away from the internal cylindrical surface 57 of the circular member 58.

The sector 48 is provided with two inclined planar surfaces 60 which in combination with the internal cylindrical surface 57 of the circular member 58 form wedged seatings for two friction rollers 61. In their wedged seatings the two friction rollers 61 are acted on by two spring devices 62 disposed intermediate the rollers 61 and the sector 48. These rollers 61 are in a position whereby, upon actuation of the push button 46, a pair of spaced arms 63 formed on the flange plate 54 are caused to engage and move them a sufficient distance to effect their release from their wedged positions in opposition to the spring devices 62. These spring devices are formed by a spring member 64 coiled about one end of a cylinder 65 which in assembled position are caused to extend from holes 66 (one only shown in FIG. 5). With this arrangement, it is possible to rotate the main shaft by means of the hand wheel 6 in the direction of the arrow A whereby rotation of the shaft 5 with respect to the eccentric 42 causes the support member 33 and the control eccentric 10 to be displaced along the dovetail shaped guide. Relative to the main shaft 5 the support member 33 and control eccentric 10 are displaced eccentrically whereby a selected amplitude of movement is provided for the connecting rod 11 which governs the distance of travel of the feed dog 17 and give the change in stitch length desired.

When the push button 46 is released, the two spring devices 62 are effective in returning the two friction rollers 61 to their wedged seatings between the inclined planar surfaces 60 and the internal cylindrical surface 57 thereby placing the sector 48 in locking engagement with the circular member 58. As shown in FIG. 5, the friction rollers 61 are disposed in their respective seatings in opposed relation with respect to the main shaft 5 so that in whatever direction the latter is caused to rotate intermediate self-locking occurs between the sector 48 and the circular member 58.

During sudden and high accelerations of sewing machines with the dovetail described supra, an advantage is provided whereby with rotation of shaft 5 in the direction of arrow A (FIG. 5) is responsible for the locking which prevents any possible relative displacement between the sector 48 and the circular member 58.

Additionally, when the feed dog is subjected to forces greater than those encountered during routine seaming, such as those caused by an increase in thickness of a workpiece or from seam crossing, the locking between the parts 48 and 58 is accomplished by the right hand roller 61. Locking in this manner avoids any possible relative displacement between the parts which could effect a variation in the preset length of the stitch.

Although the present invention has been described in connection with a preferred embodiment, is is to be understood that modifications and variations may be resorted to without departing from the spirit and scope of the invention as those skilled in the art will readily understand. Such modifications and variations are considered to be within the purview and scope of the invention and the appended claims.

We claim:

1. A stitch adjustment device for sewing machines of the type having a support collar fixed on its main shaft and a control eccentric mounted for selective movement on the support collar, in directions transversely of the main shafts axis with a connecting rod assembled thereon for actuating the machines feed dog, said device comprising:

(a) a support ring (43) rotatably mounted on the main shaft including: (i) an adjustable eccentric (42) extending axially from one side thereof;

(b) means for locating said adjustable eccentric in operative association with the control eccentric;

(c) means for rotating said support ring and said adjustable eccentric to selectively position the control eccentric at a location for effecting a desired stitch length by the connecting rod;

(d) means for locking said support ring and said adjustable eccentric in their selected positions for maintaining the stitch length selected, said locking means including;

(i) a sector (48) fixed on one end of said support ring (43);

(ii) a circular member (58) fixed on the main shaft in operative association with said sector and having an internal cylindrical surface (57); and (iii) means for holding said sector (48) in locking engagement with said internal cylindrical surface (57); and (e) means for releasing said locking means to permit actuation of said rotating means and a described change in the stitch length.

2. The structure according to claim 1, wherein said holding means defines:

(a) an inclined planar surface (60) formed on each side of said sector (48); and (b) a spring biased friction roller (61) interposed between each said inclined planar surface (60) and said internal cylindrical surface (57).

3. The structure according to claim 2, wherein said releasing means includes:

(a) a flange plate (54) slidably mounted on said support ring (43) in operative association with said sector (48) including:

(i) a pair of spaced arms (63) disposed in alignment with said spring biased friction rollers (61); and (b) a push button (46) for moving said flange plate (54) a sufficient distance for causing said arms (63) to engage and release said friction rollers (61) from locking engagement with said inclined planar surfaces (60) and said internal cylindrical surface (57).

* * * * *